US006497966B2

(12) United States Patent
Cohen

(10) Patent No.: US 6,497,966 B2
(45) Date of Patent: Dec. 24, 2002

(54) LAMINATED ARMOR

(76) Inventor: Michael Cohen, Kibbutz Kfar Etzion, Mobile Post North Yehuda 90200 (IL)

( * ) Notice: Subject to any disclaimer, the term of this patent is extended or adjusted under 35 U.S.C. 154(b) by 0 days.

(21) Appl. No.: 10/010,003

(22) Filed: Dec. 6, 2001

(65) Prior Publication Data

US 2002/0094406 A1 Jul. 18, 2002

(51) Int. Cl.[7] ..... B32B 15/08; F41H 5/02

(52) U.S. Cl. ..... 428/626; 89/36.01; 89/36.02; 139/420 R; 428/649; 428/650; 428/651; 428/652; 428/653; 428/656; 428/660; 428/681; 428/682; 428/683; 428/684; 428/686; 428/76; 428/433; 428/457; 428/911

(58) Field of Search ..... 428/626, 649, 428/650, 651, 652, 653, 656, 660, 681, 682, 683, 684, 686, 76, 433, 457, 911; 139/420 R; 89/36.01, 36.02

(56) References Cited

U.S. PATENT DOCUMENTS 3,793,648 A * 2/1974 Dörre et al. ..... 89/36.02
4,061,815 A * 12/1977 Poole, Jr. ..... 428/911
4,529,640 A * 7/1985 Brown et al. ..... 428/911
6,112,635 A * 9/2000 Cohen ..... 89/36.02

FOREIGN PATENT DOCUMENTS

FR 2137195 A * 12/1972
GB 1142689 A * 2/1969

* cited by examiner

*Primary Examiner*—Robert R. Koehler
(74) *Attorney, Agent, or Firm*—Fulbright & Jarorski L.L.P.

(57) ABSTRACT

The invention provides a composite, laminated armor panel (10) for absorbing and dissipating kinetic energy from projectiles (12), the panel (10) comprising a first outwardly-positioned layer (14) made of a hard material selected from a ceramic material and a metal having a Rockwell-C hardness of at least 27, an intermediate layer (16) softer than the first layer (14), made of a material selected from aluminium and metals having a Rockwell-C hardness of less than 27 and a third backing layer (18) of tough woven textile material, wherein the three layers (14,16,18) are laminated together and wrapped on at least four sides in a further tough woven textile material (20) which is bonded to the outer surfaces of the composite, laminated armor panel (10).

7 Claims, 1 Drawing Sheet

LAMINATED ARMOR

The invention provides a composite, laminated armor panel for absorbing and dissipating kinetic energy from projectiles, and resists delamination in use. The panel comprises a lamination of at least three layers. A first outwardly positioned layer is made of a hard material such as a ceramic material or a metal having a Rockwell-C hardness of at least 27. An intermediate layer is softer than the first layer, being made of aluminium or other metals having a Rockwell-C hardness of less than 27. A third backing layer comprises tough woven textile material. All layers are laminated together and wrapped on at least four sides in a further tough woven textile material, which is bonded to the outer surfaces of the composite armor panel. The woven textile material wrapping the panel is preferably made of aramide synthetic fibers or polyethylene fibers.

FIELD OF INVENTION

The present invention relates to armor for protection against projectiles.

More particularly, the invention provides a lightweight multi-layer armor plate resistant to delamination.

BACKGROUND OF THE INVENTION

The aim of armor systems is to prevent the penetration of projectiles into a protected area by using protective panels of acceptable weight, volume and cost. There are additional considerations such as durability, ease of fabrication and ease of repair if needed that will impinge on the selection of suitable armor.

A further feature of a satisfactory armor system is that it is not degraded by a first projectile to such extent that a following projectile will penetrate the panel. Generally, weight is the overriding consideration in aircraft, volume and weight are important in land vehicles, and cost is the main criteria in naval vessels and stationary applications.

The traditional method of armoring vehicles has long been the use of thick steel plates. Such armor is still used today in applications where weight is not of vital concern, for example in large naval vessels and in stationary applications.

The main use of such armor in land vehicles has been in tanks. However contradictory requirements that the tank be fast and mobile, yet survive being hit by a shell from an opposing tank have posed a dilemma to tank designers. Much thought and experiment was devoted to the problem before and during the Second World War. The dilemma is well illustrated by a tank of German design, which was in use at the end of the war. The athe PzKpfw VI Ausf E Tiger tank was provided with steel armor varying in thickness between 26 and 110 mm. The tank weighed 57 ton, and a 694 hp engine was needed to drive this vehicle at its modest maximum speed of 37 km/h.

With the development of the HEAT (High Explosive Anti-Tank) shell, armor designers were faced with a warhead having a shaped copper-lined hollow in the forward edge of the explosive filling which detonated a short distance from the target armor. The explosive charge adopted a shape that created a jet of vaporized copper which burned through the armor. The warhead includes a mass of plastic explosive that is plastered by impact to the outer face of the steel armor and is then detonated.

Threats of this type led to the development during the past 40 years of more complex armor systems, thinner versions of which were later adapted for use in the protection of medium-weight road vehicles from rifle and machine-gun fire. Multi-layer armor was developed and proved in many decades as having an improved penetration resistance/weight ratio relative to steel. Further innovations effected concern the use of ceramics, artificial fibers, and various arrangements designed to deflect the projectile sideways in an outer layer so that an inner layer of the armor could contain the projectile fragments. Such armor systems weigh significantly less than a solid steel panel providing equivalent protection.

Reduced weight has enabled armor manufacturers to also meet the demand for protection of lighter road vehicles, mainly for military use, but increasingly also for civilian buses, vans and cars. Due to the large size of this market, much effort has been invested in developing armor that meets the difficult weight-volume-cost constraints for light vehicles. As has been explained in our previous Patent (U.S. Pat. No. 6,112,635), armor for light vehicles is expected to prevent penetration of rifle bullets of any type, even when close-range fire is absorbed at velocities in the range 700 to 1000 meters per second. At present it is impracticable to protect light vehicles against high caliber armor-piercing projectiles, e.g. 12.7 and 14.5 mm, because the weight of suitable armor would impede the mobility and performance of such vehicles, and because room is not available for armor of the requisite thickness.

With regard to military aircraft, armor has been provided for the area where the pilot and navigator sit. No method of armoring a complete aircraft is known.

A large volume of patents has been issued for composite armor. The following are believed to be representative of the state of the art.

King in British Patent No. 1,142,689 discloses an armor plate including a non-metallic matrix, which rigidly holds bodies of a hard shatter-resistant material. When such body is shattered by a projectile, the projectile is also fragmented, the fragments being absorbed by the matrix.

A more complex arrangement is disclosed by Poole in U.S. Pat. No. 4,061,815. He proposes sandwiching at least one layer of polyurethane between rigid impact-resistant sheets of material such as aluminium armor plate or fiberglass and a thin retaining sheet on the far side. An optional ceramic or metallic filler is embedded in the polyurethane. The lightweight armor is claimed to be suitable for aircraft. However as the lamination is between 2–5 inches thick, it is difficult to imagine how such a high volume armor could be fitted into existing airplanes.

In British patent No. 1,352,418 to the German company Feldmuhle Anlagen-und Produktions, the claimed innovation is high temperature bonding of adjacent layers. A first layer comprises at least 90% by weight of sintered alumina. At least one intermediate layer is metallic and has a greater coefficient of thermal expansion. The layers are bonded together at above 500° C.

The present inventor has disclosed a composite armor panel in U.S. Pat. No. 6,112,635, which patent makes reference to a substantial number of prior-art patents for armor plate. An internal layer of $Al_2O_3$ pellets, preferably round, flat cylindrical or spherical, having an axis of at least 12 mm is bound in a solidified material. Most pellets are in direct contact with at least 6 other pellets. Outer layers of synthetic fibers or aluminium can be added. The panel resists several high-speed projectiles even if all rounds successively impact the same small area.

A weakness of prior-art composite armor, which has not been accorded adequate consideration, concerns the problem of local delamination, which can occur as a result of impact, typically with a high-speed projectile. Following such delamination, the effected area loses much of its protective properties, resulting in a following round penetrating the armor plate in the delaminated area.

It is therefore one of the objects of the present invention to obviate the disadvantages of prior art armor systems and to provide a composite armor panel that has improved resistance to delamination.

The present invention achieves the above objects by providing a composite, laminated armor panel for absorbing and dissipating kinetic energy from projectiles, said panel comprising:

a) a first outwardly-positioned layer made of a hard material selected from a ceramic material and a metal having a Rockwell-C hardness of at least 27;

b) an intermediate layer softer than said first layer, made of a material selected from aluminium and metals having a Rockwell-C hardness of less than 27; and c) a third backing layer of tough woven textile material; wherein said three layers are laminated together and wrapped on at least four sides in a further tough woven textile material which is bonded to the outer surfaces of said composite, laminated armor panel.

In a preferred embodiment of the present invention there is provided a composite, laminated armor panel wherein the first layer is formed of titanium, hard carbon steel or ceramics.

In a most preferred embodiment of the present invention there is provided a composite, laminated armor panel wherein the intermediate layer is formed of low carbon steel, medium carbon steel or aluminium.

Yet further embodiments of the invention will be described hereinafter.

The believed cause of delamination of multi-layer armor panels when impacted by a projectile is the dissipation of kinetic energy by a projectile, which does not penetrate the panel. Such energy is dissipated in several ways, among them the application of shock vibration to an intermediate layer, which shock waves propagate laterally and horizontally to adjoining areas. In the present invention, the tightly wrapped outer layer absorbs a part of such energy and prevents loosening or separation of the armor panel layers.

It will thus be realized that the novel armor of the present invention, by resisting delamination provides improved protection from the second, third and following rounds to impact the panel, and not merely from the first. Furthermore, additional and unexpected benefits are derived from wrapping the panel in an impregnated tough woven textile material such as Kevlar®.

The wrapping prevents the ingress of toxic chemicals used in chemical warfare. Vehicle contamination is thus reduced and decontamination by conventional flushing equipment is readily performed.

The hard materials used for the outer layer are naturally brittle, but are advantageous in effecting projectile velocity reduction and in particular in deforming the projectile, thereby easing the task of inner layers of the armor. The wrapping bonded to the hard outer steel plate reduces crack propagation in the hard material when hit by a projectile. This brings about a further improvement in the capacity of the composite armor plate of the present invention to resist multiple impacts in a small defined area of the panel.

While during ballistic tests the bullets are fired directly at 90 degrees to the armor panel, armor used in the field will receive the vast majority of projectiles at some angle to the armor other than perpendicular. As the bullet punches through the hard outer skin, part of the bullet is already in contact with the softer intermediate layer. Because the plane common to the outer and intermediate armor layer will rarely be precisely perpendicular to the bullet axis, the bullet will be fragmented or at least deflected from its course in a manner analogous to the refraction of light waves on a plane surface bounding two different transparent media. The third armor layer is then able to prevent penetration of the deflected bullet or its fragments.

Ballistic tests were performed to validate the design. Test results obtained and listed herein fully validated expectations from the specified armor panel.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
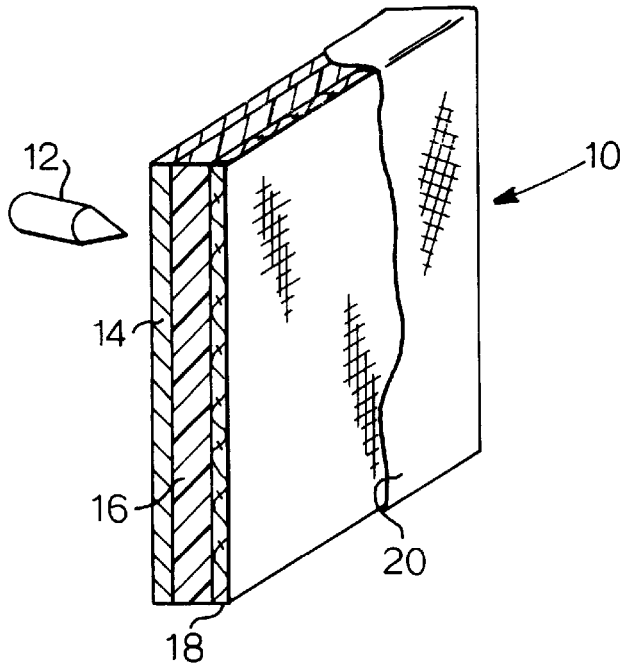
FIG. 1 is a perspective view of a preferred embodiment of the armor panel according to the invention.

There is seen in FIG. 1 a composite, laminated armor panel 10 for absorbing and dissipating kinetic energy from one or more projectiles 12. A first outwardly positioned layer 14 is made of a material having a Rockwell-C hardness of at least 27. Equivalent hardness is a Rockwell-A hardness of at least 63.8 and a Rockwell-D hardness of at least 45.2.

Suitable materials for the outwardly positioned layer 14 include ceramic materials, for example zirconia-toughened ceramic and fiber-reinforced ceramics. Ceramic materials, which are not toughened, could be used for stationary applications but are not recommended for mobile use. Ceramics have advantages regarding low weight and resistance to high temperatures.

Suitable metals include titanium alloy, mainly for aircraft use, and hard carbon steel—a relatively low cost material—for general application. The primary advantage of metals is that they can more easily be fabricated to a required shape and size.

The first outwardly positioned layer 14 is bonded to an intermediate layer 16, which is softer than the first layer 14. Bonding method used depends on the composition of the two materials.

Suitable materials for the intermediate layer 16 include aluminium alloys, magnesium alloys, low carbon steel, medium carbon steel and aluminium, in all cases having a Rockwell-C hardness of less than 27. This hardness is equivalent to a Rockwell-A hardness of less than 63.8 and a Rockwell-B hardness of less than 100. The softer metals are more ductile, and thus absorb energy over a greater distance when driven by a projectile.

The intermediate layer 16 is bonded to a third, backing layer 18 of tough woven textile material, preferably aramide synthetic fibers and polyethylene fibers. Suitable synthetic fibers are sold under trade names such as Dyneema® and Kevlar®.

The panel 10 is then structurally wrapped by material 20, as will be described with reference to FIG. 2.

Figure 2:
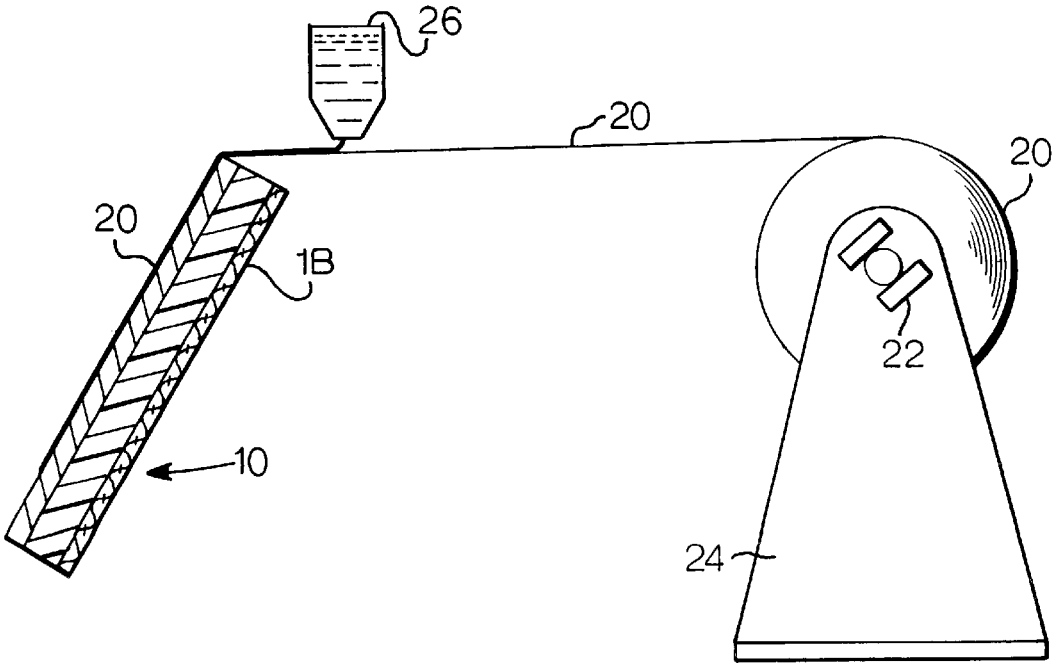
FIG. 2 is a diagrammatic view of a panel being wrapped by a continuous sheet.

Referring now to FIG. 2, there is seen the composite, laminated armor panel 10 being structurally wrapped to prevent delamination in use. In the preferred embodiment shown, the wrapping material 20 is a single continuous sheet, which forms an integral component of the panel.

The laminated 3-ply panel is seen being wrapped on four sides in a further tough woven textile material 20, which can be similar or identical to material used for construction of the third backing layer 18. The structural wrapping material 20 is bonded to the outer surfaces of the panel 10 while wrapping tension is maintained. A brake 22 used on the feed roll holder 24 can be used for this purpose. Application of an epoxy resin 26 is the preferred method of bonding the structural wrapping material 20 to the panel 10.

Advantageously all six sides of the panel 10 are wrapped by subsequently rotating the panel 90 degrees and applying further structural wrapping material 20.

TEST RESULTS

The following ballistic test was carried out on a prototype panel made according to the present invention.

A composite laminated armor panel was prepared having a first layer of $Ti_6Al_4V$ 0.5 inches thick and having a Rockwell-C hardness of 34, a second intermediate layer of aluminum, 1.14 inches thick and having a Rockwell-B hardness of 54 and a third layer of Dyneema® having a thickness of 0.9 inches.

A polyurethane glue was applied in a thin coat to the interfacing surfaces of the three layers and then to the outer surfaces thereof, a three-ply Kevlar® woven textile material was wound around all sides of the composite panel which as then placed under pressure in a clamping device similar to that used for laminating Formica® to wood tabletops.

The panel, having a size of 1 m by 1 m, a weight of 161 kg and a thickness of 2.9 inches was repeatedly fired upon with 0.50 Ammunition at a distance of 13.5 m. The panel was tested for the effects of multi-impact resistance to delamination. The panel was not tested for penetration or trauma at this time.

Twenty-two rounds of 0.50 cal. ammunition were fired at said panel without any delamination being observed.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A composite, laminated armor panel for absorbing and dissipating kinetic energy from projectiles, said panel comprising:

a) a first outwardly-positioned layer made of a hard material selected from a ceramic material and a metal having a Rockwell-C hardness of at least 27;

b) an intermediate layer softer than said first layer, made of a material selected from aluminium and metals having a Rockwell-C hardness of less than 27; and c) a third backing layer of tough woven textile material;

wherein said three layers are laminated together and wrapped on at least four sides in a further tough woven textile material which is bonded to the outer surfaces of said composite, laminated armor panel.

2. A composite, laminated armor panel according to claim 1, wherein said wrapping material is a single continuous sheet.

3. A composite, laminated armor panel according to claim 1, wherein said first layer is formed of a material selected from the group consisting of titanium, hard carbon steel and ceramics.

4. A composite, laminated armor panel according to claim 1, wherein said first layer is selected from a material having a Rockwell-C hardness of at least 27, a Rockwell-A hardness of at least 63.8 and a Rockwell-D hardness of at least 45.2.

5. A composite, laminated armor panel according to claim 1, wherein said intermediate layer is formed of a material selected from the group consisting of low carbon steel, medium carbon steel and aluminium.

6. A composite, laminated armor panel according to claim 1, wherein said intermediate layer is formed of a material selected from a material having a Rockwell-C hardness of less than 27, a Rockwell-A hardness of less than 63.8 and a Rockwell-B hardness of less than 100.

7. A composite, laminated armor panel according to claim 1, wherein said tough woven textile material is selected from the group consisting of aramide synthetic fibers and polyethylene fibers.

* * * * *